US006747415B2

(12) United States Patent
Moser

(10) Patent No.: US 6,747,415 B2
(45) Date of Patent: Jun. 8, 2004

(54) ELECTROLUMINESCENT LIGHT ARRANGEMENT

(75) Inventor: Helmut Moser, Karlsruhe (DE)

(73) Assignee: Fer Fahrzeugelektrik GmbH, Eisenach (DE)

( * ) Notice: Subject to any disclaimer, the term of this patent is extended or adjusted under 35 U.S.C. 154(b) by 0 days.

(21) Appl. No.: 10/324,056

(22) Filed: Dec. 20, 2002

(65) Prior Publication Data

US 2003/0127989 A1 Jul. 10, 2003

(30) Foreign Application Priority Data

Dec. 27, 2001 (DE) ..... 201 20 977 U

(51) Int. Cl.[7] ..... G09G 3/10

(52) U.S. Cl. ..... 315/169.3; 315/169.1; 313/505; 313/507; 345/45

(58) Field of Search ..... 315/169.3, 169.1; 257/88, 89, 91, 103, 40; 313/498, 500, 505, 507, 509; 345/44, 45, 206

(56) References Cited

U.S. PATENT DOCUMENTS 2,684,450 A 7/1954 Mager et al.
3,877,790 A * 4/1975 Robinson ..... 349/143
3,976,485 A * 8/1976 Groner ..... 430/38
5,804,918 A 9/1998 Yazawa et al.
6,054,725 A * 4/2000 Liedenbaum et al. ..... 257/91
6,369,491 B1 * 4/2002 Nakagawa et al. ..... 310/364

FOREIGN PATENT DOCUMENTS

DE 38 02 317 A1 8/1989
JP 264496 A * 9/2001
JP 313586 A * 10/2002

OTHER PUBLICATIONS

Patent Abstracts of Japan, Publication No. 06104087, Date of Publication Apr. 15, 1994, Matsuhita Electric Ind Co., Ltd.
Patent Abstracts of Japan, Publication No. 2000188181, Date of Publication Jul. 4, 2000, Canon, Inc.

* cited by examiner

*Primary Examiner*—Haissa Philogene
(74) *Attorney, Agent, or Firm*—Sughrue Mion, PLLC

(57) ABSTRACT

In an electroluminescence light arrangement comprising a carrier substrate (1) of an electrically insulating material on which there is an electrically conductive layer from which there are formed at least two conductor track regions which are electrically insulated from each other and which form a first electrode (3) and a second electrode (5) and are covered over by a pigment layer (14) whose doped pigments light when an ac voltage is applied to the two electrodes, to increase the light brightness it is provided that at least in a portion of its surface the pigment layer (14) is covered over by a thin transparent electrically conductive cover layer (16) to which in operation no additional voltage is applied from the exterior.

12 Claims, 1 Drawing Sheet

ELECTROLUMINESCENT LIGHT ARRANGEMENT

BACKGROUND OF THE INVENTION

The invention concerns an electroluminescence light arrangement of the kind known for example from laid-open German application DE-OS) No 198 02 269. That publication describes planar electrode arrangements which are provided on a circuit board substrate in relation to which an ac voltage is applied to two comb-shaped mutually interlaced electrodes (interdigital electrodes), in order to cause an electroluminescence layer applied by printing to those electrodes to light up. That layer can include a carrier substance which is a good electrical insulator so that there is no need for a separate insulation layer. If the two electrodes are disposed in the same plane, there must be a minimum spacing between them and an excessively high ac voltage may not be applied so that no electrical short-circuits occur. Under those conditions however, only a very weak electroluminescence lighting effect can be achieved with such an arrangement.

To resolve that problem, the above-indicated publication proposes that the two electrodes are to be arranged in different planes, that is to say one is to be arranged higher than the other, while a layer comprising a dielectric which is a good electrical insulator is to be provided between them. In the projection direction which is perpendicular to the surface covered by the electrodes and in which the electroluminescence lights are perceived, the horizontal spacings of the electrodes can then be as small as may be desired and may even be made zero as in fact the vertical spacing provides for sufficient electrical insulation. A disadvantage with that arrangement is that an increased number of layers have to be applied to the carrier substrate, whereby the manufacturing costs are increased, and in particular the at least two electrodes cannot be produced in a single working operation from the metallic coating which covers the carrier substrate.

SUMMARY OF THE INVENTION

In comparison therewith the object of the present invention is to develop an electroluminescence light arrangement of the kind set forth in the opening part of this specification, in such a way that the at least two electrodes can be provided in the same surface and nonetheless it is possible to achieve a marked increase in the brightness of the electroluminescence lighting effect.

It has surprisingly been found that, with the same amplitude and frequency of the ac voltage applied between the two electrodes, the light yield which can be attained is considerably improved by applying over the electroluminescence or pigment layer a thin cover layer which is transparent but a good electrical conductor and which does not have any contacts that lead outwardly. A particular advantage is that the difficulties which otherwise occur in terms of contacting thin transparent cover electrodes are completely eliminated here.

Advantageous configurations of the electroluminescence light arrangement according to the invention are set forth in the appendant claims.

BRIEF DESCRIPTION OF THE DRAWING

The invention is described hereinafter by means of an embodiment with reference to the drawing in which.

DETAILED DESCRIPTION OF THE INVENTION

Figure 1:
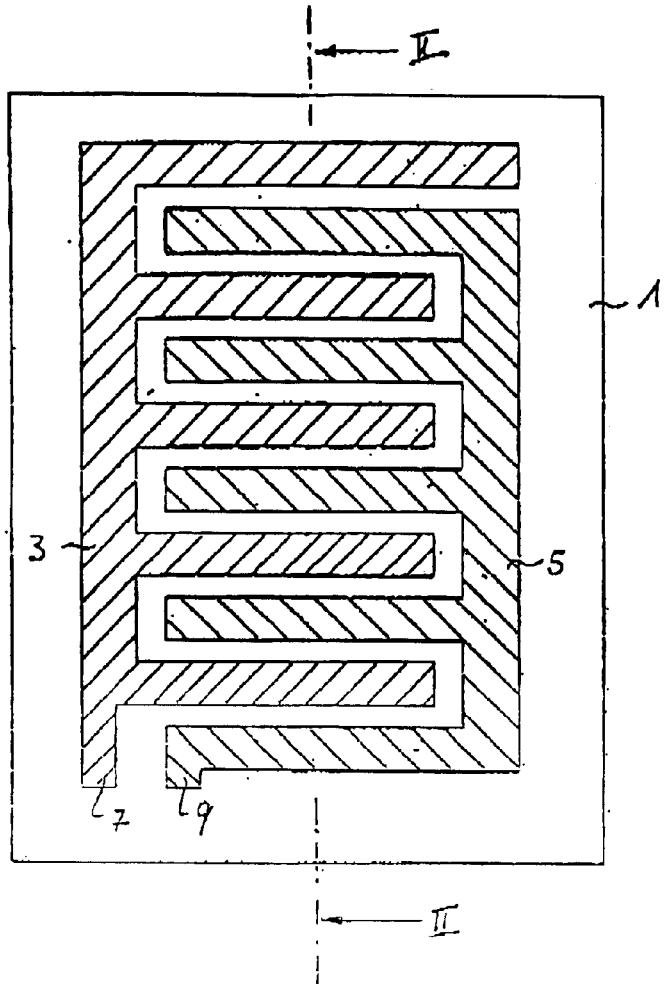
FIG. 1 is a diagrammatic, greatly simplified plan view of the carrier substrate and the conductor track configuration of an electroluminescence light arrangement according to the invention in which the layers above the conductor tracks have been omitted for the sake of enhanced clarity.
Figure 2:
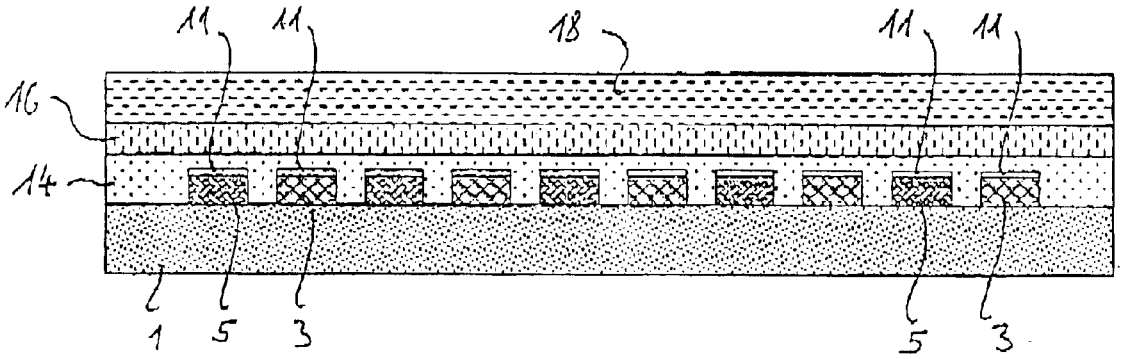
FIG. 2 is a greatly simplified diagrammatic section taken along line II—II through the arrangement of FIG. 1, here showing all layers of the electroluminescence light arrangement, which are essential for the present invention.

It should be expressly pointed out that the Figures are not true to scale and that in particular in FIG. 1 the widths and spacings of the conductor tracks and in FIG. 2 the layer thicknesses are shown on a substantially enlarged scale. The thicknesses of the layers illustrated in FIG. 2 are also not illustrated on a uniform scale.

As can be seen from FIG. 1, disposed on a carrier substrate 1 are a first electrode 3 and a second electrode 5 which have been produced for example by etching from an electrically conductive layer, which for example comprises copper, which originally covers the entire upper flat side of the carrier substrate 1. The two electrodes 3 and 5 are each of a comb-like structure and are arranged interlaced with each other and in mutually electrically insulated relationship, in the form of what are known as interdigital electrodes, so that the ac voltage required for operation of the electroluminescence light arrangement can be applied between their connecting conductor tracks 7 and 9 respectively. In that respect contacting of the connecting conductor tracks 7 and 9 is effected in any known manner, for example by soldering, bonding, crimping and so forth. It will be noted that the widths of the conductor tracks which form the first and second electrodes are so great, and the mutual spacings thereof are so small, that in operation an almost homogeneously lighting surface is produced in the surface regions covered by the conductor tracks.

As can be seen from FIG. 2, in a finished electroluminescence light arrangement according to the invention, each of the two electrodes 3 and 5 can be covered with a thin tin layer 11, which is advantageous in particular if the electrodes 3, 5 comprise comparatively dark copper. The substantially lighter tin has markedly improved reflection properties in comparison therewith and reflects upwardly again a large part of the light which in operation is emitted downwardly, that is to say towards the carrier substrate 1, thus affording an improved light output.

Disposed directly above the electrodes 3, 5 is the pigment layer 14 which also fills up the intermediate spaces between the electrodes 3, 5. That pigment layer 14 which can be selected in the most widely varying colors is a light pigment layer, that is to say a layer whose pigments emit electroluminescence light in known manner when an ac voltage of suitable amplitude and frequency is applied across the electrodes 3 and 5.

Insofar as it has been described hitherto, the electroluminescence light arrangement completely corresponds to the state of the art, with the exception of the above-mentioned tin layer 11. As discussed in the opening part of this specification however with these structures, unless additional measures are taken, there is the problem that only a comparatively weak lighting effect can be achieved even with extremely small electrode spacings and high ac voltage amplitudes.

In accordance with the invention that difficulty is overcome in that provided over the pigment layer 14 is an electrically conductive transparent cover layer 16 which is shown as being over-proportionally thick in FIG. 2 but which in actual reality is extremely thin. The cover layer 16 can be applied for example by means of a commercially available conductive lacquer. In principle this involves the same material as is used in relation to similar electroluminescence light arrangements for producing a cover electrode which is in opposite relationship to a base electrode. The essential difference is that, in regard to the last-mentioned arrangements, it is necessary to contact the cover electrode as the ac voltage required for operation of the electroluminescence light arrangement must be applied between that cover electrode and the base electrode. Such contacting involves certain difficulties as the extremely thin cover electrode can be very easily damaged by high current densities and there is also the risk that the cover electrode is pierced upon contacting from above and as a result a short-circuit is produced.

In comparison, in the arrangement according to the invention contacting of the cover layer 16 is neither provided nor is it required. It involves a 'floating' electrode which automatically assumes the potential which arises by virtue of the application of an ac voltage to the electrodes 3 and 5. Nonetheless with conditions being otherwise unchanged it produces substantially brighter lighting of the pigment layer.

In order to protect the overall arrangement mechanically and in particular from the ingress of moisture, there is a transparent protective layer 18 which also encloses the side edges of the electroluminescence light arrangement, in a manner not shown here.

The carrier substrate 1 can be formed by any suitable electrically insulating material. This may involve both a stiff board and also a flexible plastic film, as is commercially available already provided with a copper coating.

It is also possible to use a carrier substrate which carries an electrically conductive coating on both sides so that an electroluminescence light arrangement which is of the above-described substructure can be provided on each flat side.

It is also possible for a plurality of electroluminescence light arrangements which are actuable jointly or independently of each other to be provided on one and the same flat side of a carrier substrate. For that purpose, a plurality of first and second electrodes are formed out of the electrically conductive layer in question, in which respect for example the first electrodes can be electrically conductively connected together and separate actuation of the various regions is effected by means of the second electrodes which are electrically insulated from each other.

The pigment layer of an electroluminescence light arrangement does not have to be provided with pigments of the same color in all surface regions. In addition the color of the emitted light can also be influenced by the pigment layer itself and/or the cover electrode being provided with color filter properties.

What is claimed is:

1. An electroluminescence light arrangement comprising a carrier substrate (1) of an electrically insulating material, on which there is an electrically conductive layer from which there are formed at least two conductor track regions which are electrically insulated from each other and which form a first electrode (3) and a second electrode, (5) and are covered over by a pigment layer (14) whose doped pigment light when an ac voltage is applied to the two electrodes, characterised in that at least in a portion of its surface the pigment layer (14) is covered over by a thin transparent electrically conductive cover layer (16) to which in operation no additional voltage is applied from the exterior.

2. An electroluminescence light arrangement as set forth in claim 1 characterised in that the carrier substrate (1) is flat and the further electroluminescence light arrangement extend at least over a part at least of one flat side of said carrier substrate (1).

3. An electroluminescence light arrangement as set forth in claim 1 characterised in that the first and second electrodes (3, 5) are each of a comb-like configuration and are arranged in mutually interengaging relationship.

4. The electroluminescence light arrangement as set forth in claim 3 characterised in that the conductor track regions, which form the first and second electrodes (3, 5), have widths which are sufficiently great, and have mutual spacings which are sufficiently small, that in said operation an almost homogeneously lighting surface is produced in the surface regions covered by the conductor track regions.

5. An electroluminescence light arrangement as set forth in claim 1 characterised in that the electrically conductive layer is formed by a copper coating on the carrier substrate (1), from which the at least two mutually insulated electrodes (3, 5) are produced by an etching process.

6. An electroluminescence light arrangement as set forth in claim 1 characterised in that the electrically conductive layer is applied to the carrier substrate (1) by means of a conductive lacquer.

7. An electroluminescence light arrangement as set forth in claim 1 characterised in that the conductor track regions are provided with a light covering.

8. An electroluminescence light arrangement as set forth in claim 7 characterised in that the light covering is a tin layer (11).

9. An electroluminescence light arrangement as set forth in claim 7 characterised in that the light covering is formed by an electrically insulating layer which is colored with a light pigment.

10. An electroluminescence light arrangement as set forth in claim 1 characterised in that the thin transparent electrically conductive cover layer (16) is mixed with a color pigment which is excited to light in its own color by light which in operations is emitted by the pigment layer (14).

11. An electroluminescence light arrangement as set forth in claim 1 characterised in that besides the electroluminescing pigments the pigment layer (14) includes further pigments in another color so that overall there is a color shade which differs from the color of the electroluminescing pigments.

12. An electroluminescence light arrangement as set forth in claim 1 characterised in that it is covered by a protective layer (18) which acts as a vapor barrier.

* * * * *